US009238383B2

(12) United States Patent
Hoffmuller et al.

(10) Patent No.: US 9,238,383 B2
(45) Date of Patent: Jan. 19, 2016

(54) METHOD FOR THE PRODUCTION OF SECURITY ELEMENTS HAVING MUTUALLY REGISTERED DESIGNS

(75) Inventors: Winfried Hoffmuller, Bad Tolz (DE); Patrick Renner, Reichersbeuern (DE); Manfred Heim, Bad Tolz (DE)

(73) Assignee: Giesecke & Devrient GmbH, Munich (DE)

( * ) Notice: Subject to any disclaimer, the term of this patent is extended or adjusted under 35 U.S.C. 154(b) by 1260 days.

(21) Appl. No.: 13/055,508

(22) PCT Filed: Aug. 4, 2009

(86) PCT No.: PCT/EP2009/005640

§ 371 (c)(1),
(2), (4) Date: Jan. 24, 2011

(87) PCT Pub. No.: WO2010/015381

PCT Pub. Date: Feb. 11, 2010

(65) Prior Publication Data

US 2011/0127762 A1 Jun. 2, 2011

(30) Foreign Application Priority Data

Aug. 5, 2008 (DE) ..... 10 2008 036 481

(51) Int. Cl.
*B44C 1/17* (2006.01)
*B42D 25/324* (2014.01)
(Continued)

(52) U.S. Cl.
CPC ..... *B44C 1/1704* (2013.01); *B42D 25/324* (2014.10); *B42D 25/355* (2014.10);
(Continued)

(58) Field of Classification Search
CPC .. B42D 25/324; B42D 25/328; B42D 25/445; B42D 25/455
See application file for complete search history.

(56) References Cited

U.S. PATENT DOCUMENTS 4,868,049 A 9/1989 Nelson
2005/0153107 A1 7/2005 Iijima
(Continued)

FOREIGN PATENT DOCUMENTS

DE 10 2004 035 979 A1 2/2006
DE 10 2006 021 429 A1 11/2007
(Continued)

OTHER PUBLICATIONS

International Search Report in PCT/EP2009/005640, Feb. 4, 2010.

*Primary Examiner* — Kyle Grabowski
(74) *Attorney, Agent, or Firm* — Workman Nydegger

(57) ABSTRACT

The present invention relates to a method for producing a security element (1), to a security element (1) obtainable by the method according to the invention, to transfer materials having the security elements according to the invention, and to objects of value secured by the security elements according to the invention. The security element (1) according to the invention has at least two functional layers (12, 22), whereby each functional layer forms a motif and the motifs are either congruent, or one motif represents a photographic negative of the other motif. In the method according to the invention, the motif of one functional layer (12) is transferred into the other functional layer (22) with the help of an adhesive layer (30). In so doing, there is reproduced in the adhesive layer an exact image of the motif of the first functional layer, and said image of the motif in the adhesive layer is in turn employed for reproducing an exact image of said motif or of its photographic negative in the second functional layer. The transfer of the motif from one functional layer into the other is achieved by the adhesive having areas of varying adhesive strength, induced by irradiation through the first functional layer, and bonding to the second functional layer only in the strongly adhesive areas. The non-bonded areas of the functional layer are removed.

8 Claims, 7 Drawing Sheets

Figure 1:
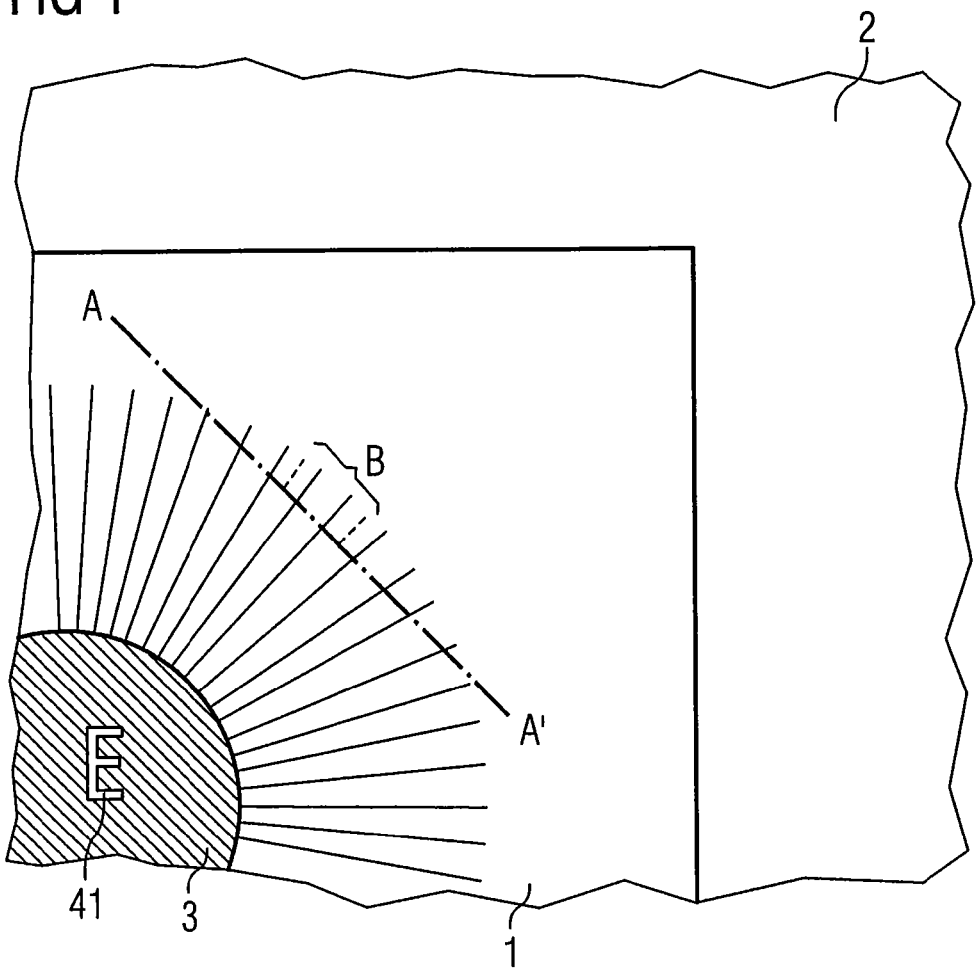

(51) Int. Cl.

| | |
|---|---|
| ***B42D 25/455*** | (2014.01) |
| ***B42D 25/355*** | (2014.01) |
| *B42D 25/328* | (2014.01) |
| *B42D 25/47* | (2014.01) |

(52) U.S. Cl.
CPC ..... *B42D25/455* (2014.10); *B42D 25/328* (2014.10); *B42D 25/47* (2014.10); *B42D 2035/08* (2013.01); *B42D 2035/24* (2013.01); *Y10T 156/1039* (2014.10)

(56) References Cited

U.S. PATENT DOCUMENTS

| | | | | |
|---|---|---|---|---|
| 2005/0170259 | A1* | 8/2005 | Holmes | 380/256 |
| 2009/0136721 | A1* | 5/2009 | Staub et al. | 428/195.1 |
| 2010/0302486 | A1* | 12/2010 | Hoshino et al. | 427/145 |
| 2011/0003166 | A1* | 1/2011 | Brehm et al. | 430/311 |
| 2011/0212387 | A1* | 9/2011 | Hansen et al. | 430/2 |

FOREIGN PATENT DOCUMENTS

| | | | |
|---|---|---|---|
| DE | 10 2007 055 112 | A1 | 7/2008 |
| EP | 1 897 700 | A2 | 3/2008 |
| GB | 2 437 941 | A | 11/2007 |
| WO | 92/11142 | A1 | 7/1992 |
| WO | 97/23357 | A1 | 7/1997 |
| WO | 99/13157 | A1 | 3/1999 |
| WO | 03/020519 | A1 | 3/2003 |
| WO | 2007/107235 | A1 | 9/2007 |

* cited by examiner

METHOD FOR THE PRODUCTION OF SECURITY ELEMENTS HAVING MUTUALLY REGISTERED DESIGNS

This invention relates to a method for producing a security element having two or more two mutually registered motif layers, in particular motif layers with symbols that are visually recognizable in transmitted light and preferably also in incident light, to a security element obtainable by means of the method, to the security element formed as a transfer element, to the use of the security element or transfer element for product protection, to an object of value equipped with the security element, and to a method for producing such an object of value.

Objects of value, in particular value documents, such as bank notes, shares, identity cards, credit cards, deeds, checks, and other papers at risk of forgery, such as identification documents of the widest range of kinds, but also branded articles and packages of branded articles, are often equipped for safeguarding purposes with security elements that make it possible to check their authenticity and at the same time serve as protection from unauthorized reproduction. The security elements can have for example the form of security threads or stickers or some other form that can be incorporated into or applied to an object of value or a security paper, whereby an "object of value" according to the present invention is any object worth being protected from forgery, in particular a value document, while a "security paper" is the value-document precursor not yet fit for circulation.

Security elements are typically multilayer elements having several functional layers. Functional layers are quite generally layers having some properties or other that can be detected visually or by machine. Hence, functional layers contain for example dyes, luminescent substances, thermochromic substances, liquid crystals, interference pigments, electrically conductive substances, magnetic substances, light-diffractive or light-refractive structures, or combinations thereof. The functional layers are usually formed as geometrical or figurative patterns or motifs, i.e. within a layer there are functional areas with the detectable property (for example luminescence) and gaps therebetween. When several functional layers are arranged one over the other, it is normally desirable that the functional areas and the gaps in the individual functional layers are formed in exact register, i.e. with high register accuracy, and with sharply contoured edges between the functional areas and the gaps one above the another. In this manner it is possible to hide one functional layer under another, for example magnetic substances under an ink layer, or to produce security elements with several functional layers and "negative writing". Security elements with negative writing have a transparent substrate with at least one non-transparent coating which has gaps (the negative writing). Said gaps can have arbitrary shapes, for example letters, numbers or patterns of any kind, in particular line patterns. Therefore, the term "negative writing" employed in this application comprises gaps of arbitrary shape, i.e. any non-all-overness in a non-transparent coating. The more transparent, i.e. the more light-transmissive, the carrier substrate is, the more pronounced the contrast is between coated and uncoated areas. With very transparent substrates the negative writing is clearly recognizable in incident light, with less transparent substrates only in transmitted light. When such a security element with negative writing has two different functional layers, for example a motif in the form of a gold-colored metallic coating and thereon the same motif as red printing ink, said motif appears to the viewer gold-colored when seen from one side, and red when seen from the other side.

Such multilayer motifs are difficult to imitate on account of the high register accuracy required. In particular motifs with negative writing offer good protection from forgery, because inaccuracies upon production are recognizable especially easily in transmitted light, and "primitive" attempts at forgery, for example copying on color copiers, are immediately recognizable even to the unpracticed eye.

The forgery resistance is the higher, the finer the structures in the functional layers with the mutually registered motifs are. However, forming extremely fine structures with sharp contours and in perfect mutual register is a challenge even for authorized manufacturers. There are a number of known methods that are supposed to make it possible to form gaps in several superposed functional layers in exact register, i.e. congruently in all layers.

From WO 92/11142 it is known to generate negative writing in functional layers by means of printing inks activatable by the action of heat. The printing inks are printed on in the form of the desired negative writing under the functional layers and contain waxes or foaming additives which, upon heating, soften or split off a gas and thereby generate foam structures. Thus, the adhesion is reduced in the areas printed with the activatable printing ink, and the functional layers can be removed mechanically in said areas.

DE 10 2007 055 112 A1 discloses a method for registered, i.e. congruent, formation of negative writing in several functional layers with the help of a printing ink printed on under the functional layers in the form of the negative writing to be formed, said ink containing a constituent which, upon irradiation or upon heating or upon contact with a wash liquid, causes a process which leads to a force being exerted by the printing ink on the superjacent coating so as to make the coating break open. Said force can be exerted by a gas which is generated by constituents of the printing ink when they come in contact with wash liquid, are irradiated and/or heated, or by a swelling agent in the printing ink, which swells up upon contact with a wash liquid. Once the multilayer coating is broken open, it is relatively easily accessible to being washed out with wash liquid.

The stated methods work satisfactorily provided no very fine structures are to be formed. Very fine structures can frequently not be formed with sharp contours and in exact register by the stated method, however.

Hence, it is an object of the present invention to provide a method for producing security elements that makes it possible to form congruent motifs in at least two superposed layers.

It is in particular an object of the present invention to provide such a method that makes it possible to form congruent motifs with sharp contours and high register accuracy.

It is furthermore an object of the present invention to provide such a method wherein the motifs to be formed have very fine structures.

It is also an object of the present invention to provide a security element with at least two motif layers with mutually corresponding motifs which have a high register accuracy.

It is further an object of the present invention to provide such a security element wherein the motif layers have very fine structures and are formed with sharp contours.

It is furthermore an object of the present invention to provide such security elements in the form of transfer elements, and to provide security papers and objects of value having the security elements or transfer elements according to the invention and methods for producing the security papers and the objects of value.

These objects are achieved by the method for producing a security element having the features stated in claim 1, by the security element having the features stated in claim 8, by the transfer material having the features stated in claim 15, by the security paper or object of value according to claim 16, and by the method according to claim 17.

Special embodiments of the present invention are stated in the respective dependent claims.

The basic idea of the present invention consists in transferring the motif of one functional layer into another functional layer with the help of an adhesive layer. In so doing, there is reproduced in the adhesive layer an exact image of the motif of the first functional layer, and said image of the motif in the adhesive layer is in turn employed for reproducing an exact image of said motif or of its photographic negative in a further functional layer. The transfer of the motif from one functional layer into the other is achieved by the adhesive between the functional layers being so structured with the help of the motif of the first functional layer that it adheres only to certain areas of the second functional layer but enters into no adhesive connection with the remaining areas of the second functional layer. The non-bonded areas of the second functional layer are then removed while the bonded areas cannot be removed, thereby causing an exact reproduction or a photographic negative of the motif of the first functional layer to arise in the second functional layer.

The security element according to the invention is produced from at least two partial elements. A first partial element consists at least of a carrier substrate and a functional layer with gaps therein. Further layers can be present. The functional layer can also be constructed from several single layers.

The carrier substrate of the first security-element partial element is preferably a foil, for example of polypropylene, polyethylene, polystyrene, polyester, in particular polycarbonate or polyethylene terephthalate. Transparent or translucent foils are particularly preferred. Upon a use of such foils, the gaps formed in exact register can be recognized clearly as negative writing in the individual functional layers.

On the carrier substrate a functional layer is formed. The functional layer can basically be of any type that is employed in security elements. Examples to be mentioned are metal layers of for example aluminum, iron, copper, gold, nickel, etc., metal alloys, or layers of metallic effect inks, layers with color pigments or fluorescence pigments, liquid crystal layers, coatings with a color shift effect, layer combinations such as a color-shift-effect layer underlaid with a certain color, layers with machine-detectable features, for example with magnetic pigments, which can optionally be hidden under a cover layer. The mentioned layer with color pigments can involve e.g. a black printing ink based on "Microlith black" (Ciba) which, in the security element produced according to the invention, forms a dark background for e.g. liquid crystal layers, making it possible to generate impressive color shift effects.

The application of the functional layers is effected by known methods which are suitable for the particular functional layer, for example by physical vapor deposition (PVD) in the case of metals, or by printing in the case of color pigments or fluorescence pigments.

If functional layers are printed on, they can, if desired, already be printed on in the form of the functional layer motif, i.e. in the form of functional areas and gaps between said areas. In all other cases an all-over application of the functional layer is effected, whereby printed-on functional layers can of course also be printed on all over.

The functional layer can be formed directly on the carrier substrate, or there can be provided one or several intermediate layers. For some functional layers, intermediate layers are absolutely necessary, for example when the motif of the functional layer involves a metallized hologram, Kinegram, Pixelgram or another metallized diffractive structure. In such a case, an embossing lacquer layer is first applied, and the desired diffractive structure embossed in the embossing lacquer layer, before or after the metallization. Liquid crystal layers also normally require an intermediate layer, which ensures an appropriate orientation of the liquid crystals. Suitable orientation layers can be for example diffractive structures embossed in embossing lacquer layers. Alternatively, the carrier foil can optionally also be treated suitably.

According to a preferred embodiment of the present invention, one of the motif layers is a metallized diffractive structure, such as a metallized hologram; particularly preferably, a further motif layer is also a metallized diffractive structure, such as a metallized hologram. When holograms are spoken of hereinafter, it will be understood that the same also holds for other diffractive structures and refractive structures as well as for so-called "matt structures" (grating images with achromatic grating areas) as are defined and described e.g. in WO 2007/107235 A1 (see in particular claim 1).

As mentioned above, there is to be provided in the case of holograms an embossing lacquer layer which contains the desired structural information embossed therein. The structural information is transferred as well upon bonding to the second security-element partial element. Materials for embossing lacquer layers are known to a person skilled in the art. Suitable embossing lacquers are disclosed for example in DE 10 2004 035 979 A1, which discloses heat seal lacquers that can likewise be used as embossing lacquers.

In a further step, the functional layer is structured for producing a motif, i.e. from the functional layer certain areas are removed. The remaining functional areas and the gaps together form the motif, which can be an arbitrary geometrical or figurative representation. The motif can also form a coding, or the form of the gaps can be designed such that the gaps are felt to be the "motif" by a viewer.

Methods for producing the gaps are known. Suitable ones are for example laser ablation, etching methods and washing methods. Etching methods are suitable in particular for metallic functional layers. A photoresist is applied to the metallic layer and exposed through a mask in the form of the desired motif. With positively working photoresists the areas of the later gaps must be exposed, with negatively working photoresists the later functional areas. After exposure, the photoresist is removed in the soluble areas by means of developer, and the metal layer etched away in the uncovered areas by etching agents, such as lyes or acids, so as to form the desired gaps.

Washing methods are universally applicable. Suitable washing methods are disclosed for example in WO 99/13157, WO 92/11142, WO 97/23357 and in DE 10 2007 055 112. A particularly suitable method is the one disclosed in DE 10 2007 055 112, which makes it possible to remove even relatively thick coatings, for example multilayer coatings. When this method is applied in the present invention, a special printing ink is printed on the carrier substrate or an intermediate layer, if present, in any case under the functional layer, in the areas where gaps are to be formed in the functional layer. The printing ink contains a reactive constituent and/or a precursor of a reactive constituent which, upon contact with a wash liquid, causes a process which leads to a breaking open of the functional-layer areas located over the printing ink, and/or a reactive constituent which, upon irradiation or upon heating, causes a process which leads to a breaking open of the functional-layer areas located over the printing ink. The reactive constituent in the printing ink is for example one component of a two-component gas generation system, such as a carbonate or a hydrogencarbonate, whereby the second component of the two-component gas generation system, for example an acid, such as citric acid or tartaric acid, is contained in the wash liquid. Upon contact with the wash liquid, a little acid penetrates through the functional layer into the printing ink, a gas is generated, and the functional layer is broken open at the corresponding place and can now be easily removed, optionally with mechanical support. A similar effect is exerted by swelling agents contained in the printing ink, for example starch or cellulose derivatives, which, upon contact with a wash liquid, such as water, swell up and break open the functional layer. Alternatively, the printing ink can contain expanding agents which, upon irradiation and/or heating, split off a gas, for example azoisobutyric acid nitrile, which in turn leads to a pressure increase under the functional layer and to a breaking open of the functional layer in the areas printed with the printing ink. The broken open areas of the functional layer can now be easily washed out together with the printing ink, thereby forming the desired gaps.

Next, the second security-element partial element is produced.

The second security-element partial element has, like the first security-element partial element, at least two layers, namely a carrier substrate and a functional layer formed thereon. Additionally, further layers can be present, or must be present, as stated hereinabove for the first security-element partial element.

Quite generally, the same applies to the materials, structure and production of the layers of the second security-element partial element as to the first security-element partial element, whereby it must be heeded, however, that no gaps are formed in the functional layer or the functional layer sequence. The gaps are only generated by interaction with the first security-element partial element. Moreover, the carrier substrate of the second security-element partial element is later detached, e.g. peeled off by separation winding, together with parts of the functional layer of the second security-element partial element (e.g. the parts of the functional layer that, in the assembled security element, are arranged over gaps in the functional layer of the first security-element partial element), while the carrier substrate must be strippable from other parts of the functional layer of the second security-element partial element (e.g. the parts that, in the assembled security element, are arranged over functional areas of the first security-element partial element). Hence, it is necessary that the functional layer possesses only low adhesion to the carrier substrate.

The necessary low adhesive force is already obtained, in many functional layer materials, in particular metallizations, merely by doing without adhesion-promoting measures between carrier substrate and functional layer. It is otherwise customary to take adhesion-promoting measures between the individual layers of a security element, and the corresponding precautions are known to a person skilled in the art.

When the adhesive force between carrier substrate and functional layer is too high, it can be reduced by treating the carrier substrate with suitable additives. For example, the carrier substrate can be washed off with water and/or solvents with or without suitable additives. Suitable corresponding additives are for example surface-active substances, defoamers or thickeners.

Similar considerations apply to any intermediate layers present between the carrier substrate and the functional layer, for example embossing lacquer layers for a hologram. If such an embossing lacquer layer or other intermediate layer is to be removed together with the carrier substrate, the adhesive force between the intermediate layer and the functional layer, i.e. for example between the embossing lacquer layer and a metallization applied thereto, must accordingly be low. In the case of an excessive adhesive force, the intermediate layer is to be treated with the stated additives.

If a treatment of the carrier substrate or of an intermediate layer with adhesion-reducing additives is performed, residues of the additives can remain on the functional layer after detachment of the carrier substrate or of the intermediate layer. Said residues can normally be easily washed away with an aqueous solution whose pH is adjusted suitably and which can optionally also contain surfactants. A wash with solvents is also possible. In stubborn cases it is also possible to work with high-pressure nozzles and/or mechanical support (felts, brushes), but this is usually unnecessary. Small additive residues can also be "burned away" by a corona treatment. Also, in many cases it is also possible to do completely without removing additive residues. Suitably formulated protective lacquers can also adhere sufficiently to "additive-loaded" functional layers.

Now the first security-element partial element, which has a functional layer with functional areas and gaps, and the second security-element partial element, which has a functional layer without gaps, are interconnected using an adhesive layer. A suitable adhesive layer might already be present on the first security-element partial element, namely, when the gaps were generated in the functional layer of the first security-element partial element with the help of an adhesive resist lacquer. In so doing, the gaps are produced by coating with photoresist, exposing by means of an external mask, developing and etching away the areas of the functional layer no longer protected by photoresist. On the remaining areas of the functional layer, the functional areas, there is still photoresist material, which is necessarily congruent with the functional areas. Said photoresist material can be employed as an adhesive layer, provided that it is well bondable to the material of the functional layer of the second security-element partial element under pressure and elevated temperature. If an unsuitable photoresist was used, or the photoresist areas are no longer sufficiently intact for an exact bonding, the photoresist is removed and one subsequently proceeds as in all other cases where the gaps were generated in the functional layer of the first security-element partial element without employing a photoresist. The photoresist used can involve a positive photoresist, such as AZ 1512 (AZ 1500 series) or AZ P 4620 from Clariant or S 1822 from Shipley, which is applied in a surface density of approx. 0.1 $g/m^2$ to approx. 40 $g/m^2$.

In such cases there is employed for bonding the first security-element partial element and the second security-element partial element a radiation-curing, preferably UV-curing, or a radiation-activatable, adhesive. Upon application of the adhesive and the combination of the partial elements with each other, it must be taken into account that according to the invention the adhesive force of the adhesive is so changed by irradiation employing the functional layer of the first security-element partial element as a mask that either substantially no adhesive force is present any longer in the gap areas while the adhesive force remains substantially unchanged in the functional areas, or alternatively the adhesive is activated in the gap areas but remains inactive in the functional areas. Hereinafter the first case will be described. For the latter, the reverse respectively holds with regard to the adhesive and the non-adhesive areas of the adhesive layer, and thus with regard to the bonded and the detached areas of the functional layer of the second security-element partial element.

This results in several variants with regard to the place of application of the adhesive, with regard to the orientation of the security-element partial elements relative to each other, and with regard to the order of the steps necessary for final connection, i.e. the irradiating of the adhesive layer and the assembling and bonding of the security-element partial elements together, optionally under elevated pressure and elevated temperature.

Variant 1:

The adhesive is applied to the first security-element partial element on the functional layer. In this case, the adhesive-coated security-element partial element is irradiated with radiation of a suitable wavelength from the side of the carrier foil, i.e. through the functional layer. This causes the adhesive to cure in the areas where the functional layer has gaps, and to be thereby deactivated. In the areas where the functional layer has no gaps (i.e. in the functional areas), the radiation is shielded completely or at least for the most part and, hence, the adhesive force of the adhesive is retained unchanged or at least substantially unchanged. The second security-element partial element is now so placed onto the adhesive layer that its functional layer contacts the adhesive layer. The two partial elements are pressed together, optionally under elevated temperature, thereby bonding the adhesive layer in the non-deactivated areas to the functional layer of the second security-element partial element. Because the adhesive areas of the adhesive layer correspond in dimension and form to the functional areas of the functional layer of the first security-element partial element, the bonding to the functional layer of the second security-element partial element is effected in such a way that it exactly reproduces the motif of the functional layer of the first security-element partial element. Subsequently, irradiating is effected again, if necessary, in order to further crosslink the adhesive in the areas hitherto not or hardly irradiated and thus to protect the structure from destruction in the subsequent steps. Finally, the carrier foil of the second security-element partial element is removed, optionally together with intermediate layers between carrier foil and functional layer, whereby the functional layer is also removed in the non-bonded areas, while it naturally cannot be removed in the bonded areas, resulting in a security element with two fully mutually congruent motifs. The second motif layer can optionally be covered with a protective layer.

This orientation of the security-element partial elements relative to each other is also to be chosen when an already present photoresist is used as an adhesive.

Variant 2:

The radiation-crosslinkable adhesive is applied to the first security-element partial element, but on the carrier foil, not on the functional layer as in the first variant. Here, too, the adhesive is deactivated in the areas of the gaps of the first functional layer by irradiation with a suitable wavelength employing the first functional layer as an exposure mask, while it retains its adhesive force unchanged or at least substantially unchanged in the remaining areas. Because of the greater distance between exposure mask and adhesive layer, the imaging of the motif of the functional layer in the adhesive is possibly not quite as precise here as in the first variant. Subsequently, the second security-element partial element is placed with its functional layer onto the adhesive layer of the first security-element partial element, and one proceeds as in the first variant. In the already crosslinked, i.e. cured, areas of the adhesive layer there is no bonding to the functional layer of the second security-element partial element, so that the two functional layers of the resulting security element have congruent gaps.

Variant 3:

The adhesive layer is applied to the functional layer of the second security-element partial element. In this case, the two security-element partial elements must first be assembled before irradiation, in order for the functional layer of the first security-element partial element to be employable as an exposure mask. The assembling can be effected for example in such a way that the functional layer of the first security-element partial element borders on the adhesive layer. In this case, it must be ensured that no premature bonding takes place, i.e. there must be employed an adhesive that does not bond the two security-element partial elements upon mere joining, but causes a bonding only under elevated pressure and optionally under elevated temperature. Suitable adhesives will be stated below. The security-element partial elements assembled to a composite are now irradiated through the functional layer of the first security-element partial element, thereby causing the adhesive to cure and be deactivated in the areas not shielded by the functional layer, but not in the areas shielded by the functional layer. Due to the immediate adjacency of adhesive layer and exposure mask there is achieved, as in the first variant, an extremely good fidelity of reproduction of the imaging of the motif of the first security-element partial element in the adhesive layer. Said motif is passed on to the functional layer of the second security-element partial element, whereby upon the separation of the functional layer of the second security-element partial element from the carrier substrate, or from the carrier substrate and further layers, the adhesive layer must also be severed. This can lead to a somewhat lower edge sharpness than in the first variant.

Variant 4:

The adhesive is applied to the functional layer of the second security-element partial element, as in variant 3. The two security-element partial elements are assembled in such a way, however, that the carrier substrate of the first security-element partial element is bonded to the adhesive layer. Otherwise one proceeds as in variant 3, i.e. there must be employed an adhesive that does not yet bond the two security-element partial elements upon mere loose assembling. Then irradiation is effected through the functional layer of the first security-element partial element, whereby the adhesive cures in the non-shielded areas. Subsequently, the two security-element partial elements are interconnected under elevated pressure and optionally elevated temperature. If necessary, irradiation is effected again in order to achieve a good cure in the shielded adhesive areas. Finally, the carrier substrate, and any further layers, of the second security-element partial element is removed together with the non-bonded areas of the functional layer. The areas of the functional layer remaining on the adhesive layer can be covered with a protective layer, if desired. In this variant, the distance between exposure mask and adhesive layer upon irradiation is greater than in variant 3. Hence, the imaging of the motif of the functional layer of the first security-element partial element in the adhesive layer, and thus the transfer into the functional layer of the second security-element partial element, is not quite as precise as in variant 3.

It must be noted regarding the exposure that it can be effected from a defined angle deviating from 90°. At a defined distance between the external/internal mask and the layer to be exposed, there can be obtained in an exposure at a defined angle deviating from 90° a defined offset of the motifs of the two functional layers. This makes e.g. interesting vertical-blind and see-through effects possible.

Quite generally, it must further be stated that the pressing together of the two security-element partial elements can be effected in single-stage or multistage fashion. That is, the two partial elements are pressed against each other preferably at elevated temperature in a heating roll with one so-called calender roll (single-stage pressing) or several calender rolls (multistage pressing), or else the two partial elements are pressed against each other on several heating rolls which are each equipped with one or several so-called calender rolls (multistage pressing). Multistage pressing can lead to a particularly firm connection of the security-element partial elements, depending on the particular embodiment. Upon the use of several heating rolls it is also possible to realize temperature gradations during pressing.

The most exact imaging in combination with the best edge sharpness is to be achieved in variant 1, because exposure mask and adhesive layer to be exposed border on each other directly or are separated from each other at most by a thin protective layer of the functional layer of the first security-element partial element here, and moreover the adhesive layer need not be severed. The unsharpnesses upon separation are less than 10 μm.

The order of the method of variants 3 and 4 can be used even when the adhesive is applied to the first security-element partial element, i.e. the two security-element partial elements can first be loosely assembled, then irradiated, and finally interconnected under pressure and optionally elevated temperature. It is then of course also necessary to employ a suitable adhesive, i.e. an adhesive that ensures that there is no bonding to the areas of the functional layer of the second security-element partial element that is to be removed in order to form gaps. Suitable bonding conditions are typically approx. 60° C. to 160° C. and a line pressure of typically 0.1 N/mm to 15 N/mm, particularly preferably of approx. 5 N/mm.

Suitable adhesives are disclosed for example in DE 10 2004 035 979 A1. These are adhesives, in particular dispersion adhesives, which contain at least one radiation-crosslinkable component and are crosslinked by short-wave radiation, such as ultraviolet radiation or short-wave visible radiation, or by electron beams, preferably by UV radiation. The coatings are substantially tack-free after physical drying and possess a smooth, substantially non-tacky surface. The presence of tack-freeness can be checked by the following test: coated foil pieces of about 100 $cm^2$ are stacked and loaded with a weight of 10 kg and stored for 72 hours at 40° C. If the foil pieces can be easily separated from each other thereafter without damage to the coatings, the coating is to be considered tack-free. Under elevated pressure and elevated temperature (approx. 60° C. to 160° C.), substrates coated with the adhesives can be bonded to other substrates.

Examples of suitable radiation-curing adhesives are acrylated polyurethane dispersions, such as DW 7770 and DW 7773 (UCB; Surface Specialities), anionic and non-ionic dispersions, such as NeoRad R-440 (NeoResins), Laromer 8983 (BASF), LUX 101 UV dispersion (Alberdingk), Halwedrol UV 95/92 W (Hütteness-Albertus) and Beyhydrol UV VP LS 2280 (Bayer), cationically radiation-curing resins, such as UCAR VERR-40 (The Dow Chemical Company). Especially preferred adhesives are radiation-curing compositions with photoinitiators.

Suitable photoinitiators are e.g. Irgacure 500 (Ciba) and Irgacure 819 DW (Ciba). According to a formulation example, a radiation-curing adhesive has the following composition:

| Product name | wt.-% |
|---|---|
| DW 7773 (UCB) | 94.5 |
| Irgacure 500 (Ciba) | 1.5 |
| Irgacure 819 DW | 4.0 |

The formulations can optionally contain mixtures of the dispersions and further accessory agents, such as additives (defoamers, flow-control agents, anti-block additives, tackifiers, etc.). Additionally there can be added powder lacquers, in dispersed form, which can ensure a defined melting point, on the one hand, or else can melt and participate in the radiation curing.

The radiation-curing compositions disclosed in DE 10 2004 035 979 A1 can be used not only as adhesives, but also as an embossing lacquer. In the present invention they can hence also advantageously find application when embossing lacquer structures are required, for example for metallized holograms.

According to a further variant of the present invention, there can also be generated "intarsia" motifs. In this variant, one proceeds as described above, but employing not an adhesive that is cured, i.e. deactivated, by radiation, but rather an adhesive that is activated by radiation while remaining inactive in the non-irradiated areas. In this case, there are removed, upon removal of the carrier substrate, or of the carrier substrate and other layers no longer required, the functional-layer areas of the second security-element partial element that contact non-irradiated areas of the adhesive layer, while functional-layer areas of the second security-element partial element that come in contact with irradiated areas of the adhesive layer adhere to the adhesive layer and can be bonded firmly thereto, optionally under elevated pressure and elevated temperature. In this manner there is obtained a security element that has a motif on one side of the adhesive layer and a photographic negative of said motif on the other side of the adhesive layer. If a very transparent foil is employed as the carrier substrate for the first security-element partial element, the finished security element shows an "intarsia" motif on both sides, i.e. the viewer sees the motif of the first functional layer, the gaps being filled exactly by the second functional layer. Upon use of an opaque carrier substrate there is obtained the same effect for the above-described variants 1 and 3, whereby the motif can only be seen from one side, however. In the above-described variants 2 and 4 the viewer sees the motif of the first security-element partial element on one side of the security element, and the corresponding negative on the other side of the security element.

Embodiments of the security element according to the invention that have a reflective layer as functional layers or one of the functional layers can also be equipped very well with a so-called "polarization feature". This is understood to refer to security features utilizing polarization effects for securing authenticity. Light-reflective surfaces, for example metallized holograms, are coated all over or in certain areas with a double refractive layer, a so-called "phase delay layer". Phase delay layers are able to change the polarization and phase of light passing through. The reason is that the light is decomposed into two mutually perpendicular polarization directions which pass through the layer at different speed, whose phases are thus shifted relative to each other. The shift is of different size, depending on the type and thickness of the layer, and has different effects. A $\lambda/4$ layer, i.e. a layer that delays the light in one direction by a quarter of a wavelength relative to the direction perpendicular thereto, can turn linearly polarized light into circularly or elliptically polarized light, and circularly polarized light into linearly polarized again. The phenomenon of polarization and polarizing materials are known. A security element that utilizes polarization effects for securing authenticity is described for example in DE 10 2006 021 429 A1. Upon viewing in ambient light the areas with a phase delay layer of such a security element are hardly perceptible, while upon viewing in polarized light the areas with a phase delay layer become recognizable.

If light is made to fall through a polarizer on a light-reflective surface which is coated in certain areas with polarizing material, the light is reflected with different polarization in the coated and in the uncoated areas. Upon viewing through a polarizer one thereby observes light/dark contrasts. It is essential for achieving good optical effects that the light-reflective surface does not change the polarization state of the incident light uncontrolledly. Suitable reflective layers are layers of vapor-deposited metallizations, layers of metallic effect inks, layers with interference pigments or thin-film element layers. Highly refractive layers of for example $TiO_2$ or $SiO_2$ are also suitable as reflective layers.

In the present invention, metallic functional layers, for example metallized diffractive structures or matt structures, are preferably combined with a polarization feature. The polarization feature can be executed for example as a $\lambda/4$ layer, be applied in motif form, all over or in certain areas, with only one orientation or with two or more different orientations. If the security element has reflective functional layers on both sides, both reflective functional layers can be equipped with the same or different polarization features. Transparent areas (gaps) are undisturbing. If the reflective layers are located on the same side of the carrier substrate, the carrier substrate should be isotropic or at least not show excessively strong dispersion in the optical range.

The method according to the invention wherein the motif of a functional layer is employed as an irradiation mask in order to transfer the motif into an adhesive layer, and from there into a further functional layer, can also be carried out in combination with an external irradiation mask. With external irradiation masks there cannot be attained the same high precision as with the internal irradiation mask, but if extreme precision can be done without, the combination of internal and external irradiation masks can obtain interesting effects. If, for example, the functional layer of the first security-element partial element has not only very fine, but also larger gaps, the adhesive layer can be irradiated not only through the first functional layer as an irradiation mask, but also through a further external irradiation mask, whereby the external irradiation mask has a motif in the area of the gaps of the first functional layer. In this manner there is obtained in the second functional layer a combination of the motifs of the first functional layer and of the external irradiation mask.

The method according to the invention can also be carried out several times, i.e. more than two security-element partial elements can be combined with each other. A bonding of more than two security-element partial elements can be expedient in particular when a machine-detectable functional layer is to be hidden as a middle layer between two visually recognizable functional layer motifs.

The functional layers which must be separated into areas remaining on the adhesive layer, on the one hand, and into areas to be removed with the carrier substrate, on the other hand, must not possess excessive internal strength in the horizontal direction (in the direction of extension of the adhesive layer) in order to guarantee a clean and sharp-edged separation. Functional layers whose internal strength is undesirably high are preferably applied in grid fashion. The edge of each grid point constitutes a rated breaking point, so that the transfer to the adhesive layer in this case comprises one grid point as the smallest unit. If a functional layer is constructed from several single layers, it can be sufficient to execute only one of the single layers as a stationary grid.

The invention will hereinafter be explained more closely with reference to drawings. In the figures the functional layers are depicted as metal layers, in each case in combination with an embossing lacquer layer. However, it is expressly pointed out that the present invention is by no means limited to such functional layers. It is instead possible to use arbitrary functional layers in arbitrary combinations, for example layers of printing inks, metallic effect inks, interference pigments, liquid crystal layers and combinations of layers, for example ink layers with layers of interference pigments thereon. Moreover, further layers as are customary in the field of security elements can be contained in the security element structures, for example protective layers or release layers in the case of transfer elements, adhesion-reducing layers for easier detachment of the functional-layer areas that are to remain on the adhesive layer, etc. It is evident that the additional layers must not disturb the method sequence, for example must not too strongly shield the radiation employed for irradiating the adhesive layer. Thus, there must be employed for example as the carrier substrate of the first security-element partial element a material that is sufficiently transmissive to the employed radiation. Further, it is pointed out that the depictions are of course not true to scale. In particular, the individual layers are depicted with strongly exaggerated height.

Figure 2A:
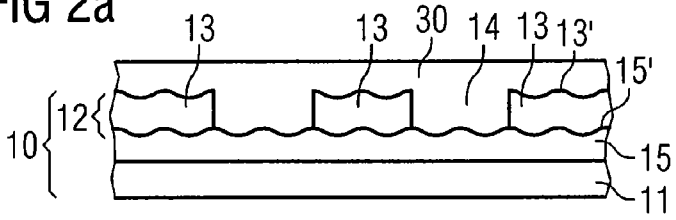
Figure 2B:
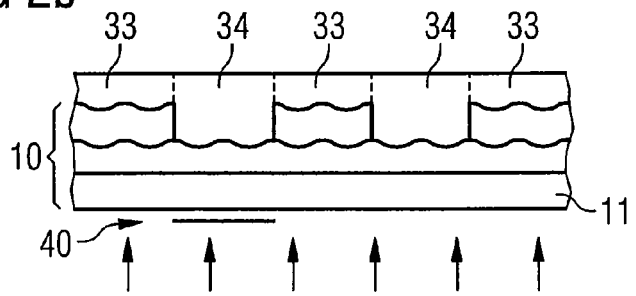
Figure 2C:
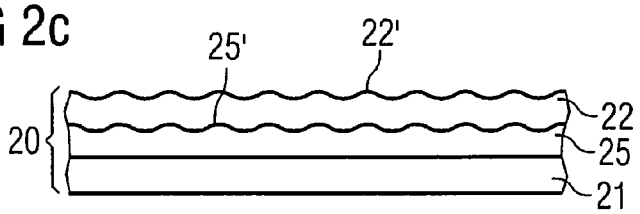
Figure 5A:
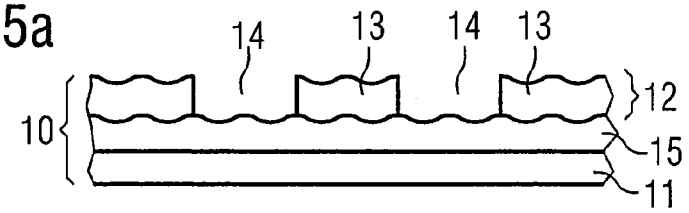
Figure 5B:
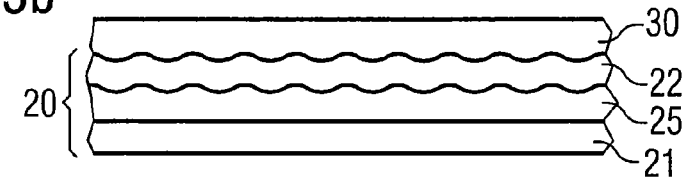
Figure 5C:
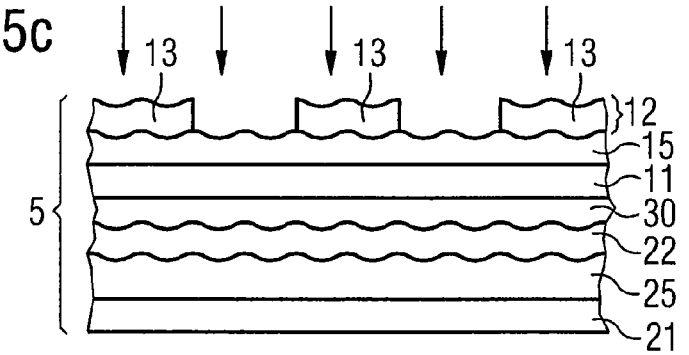
Figure 5D:
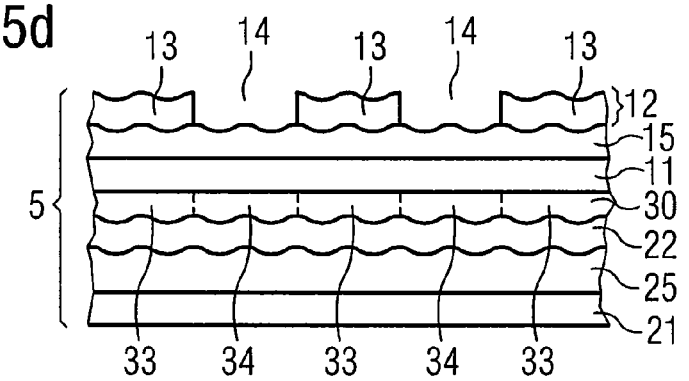
Figure 5E:
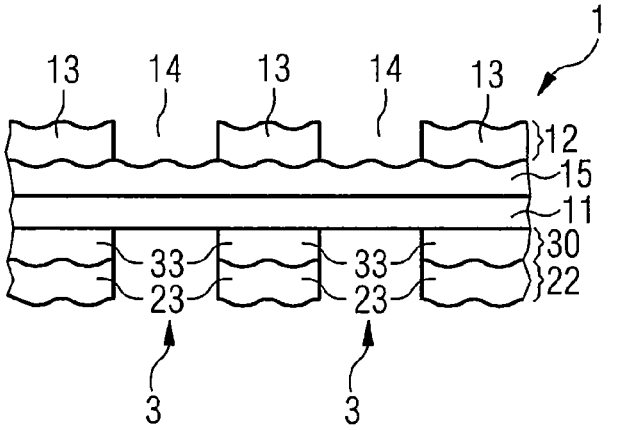
Figure 6A:
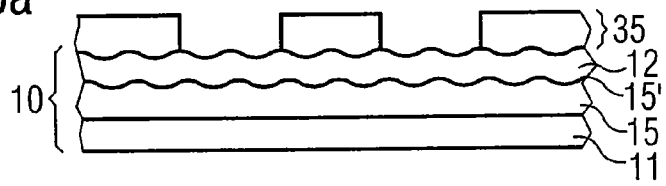
Figure 6B:
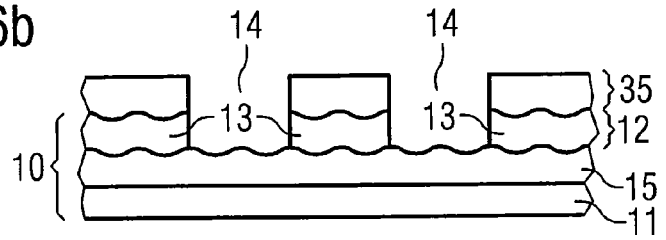
Figure 6C:
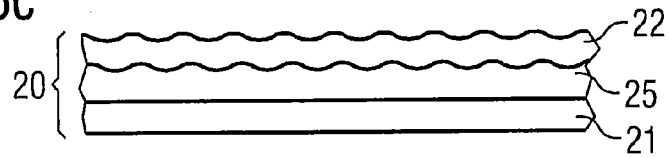
Figure 6D:
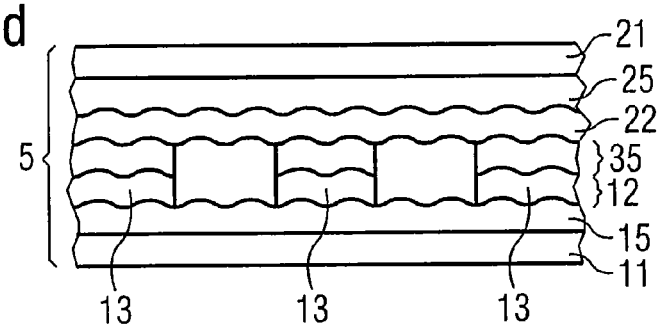
Figure 6E:
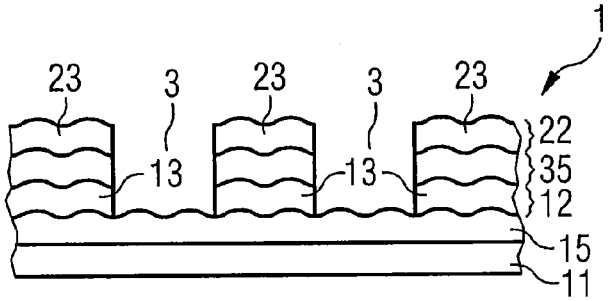
Figure 6F:
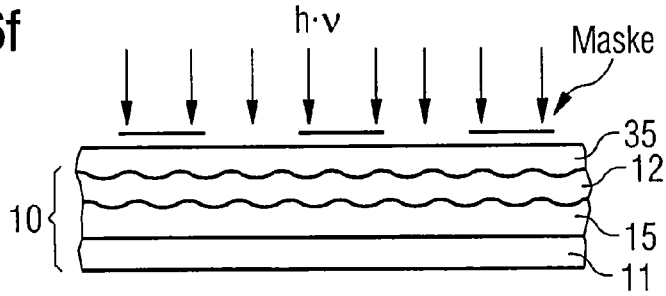
Figure 7A:
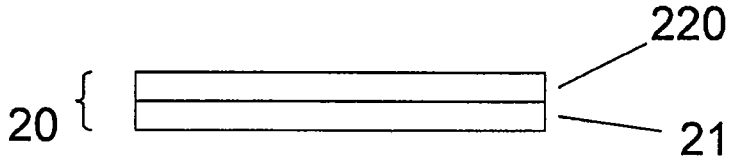
Figure 7B:
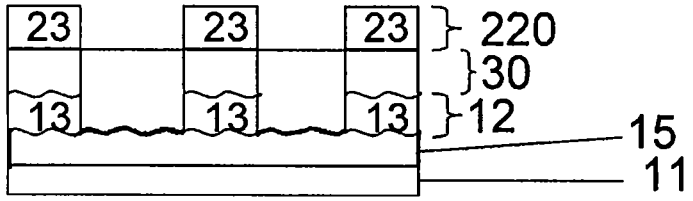
Figure 7C:
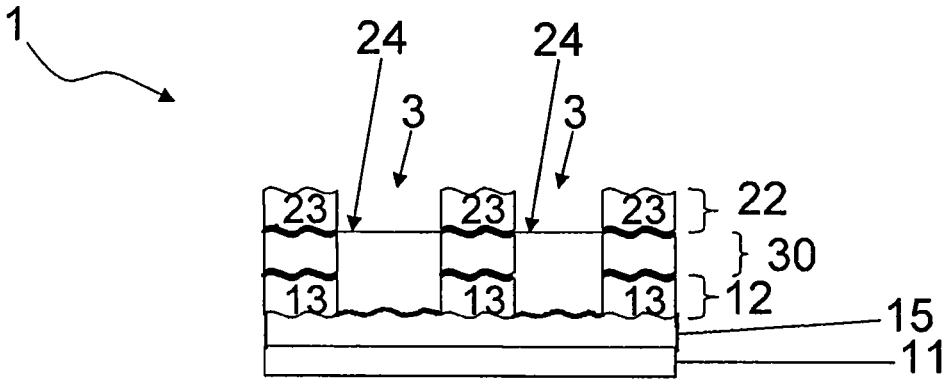

In the figures there are shown:

FIG. 1 a detail of a value document with a security element according to the invention, in plan view, FIG. 2 to FIG. 6 respective method sequences in the production of a security element according to the invention, illustrated by sections through the security element of FIG. 1 along the line A-A' in detail B, whereby FIGS. 2*a* to 2*e* show the above-described variant 1, FIGS. 3*a* to 3*e* show the above-described variant 2, FIGS. 4*a* to 4*e* show the above-described variant 3, FIGS. 5*a* to 5*e* show the above-described variant 4, FIGS. 6*a* to 6*f* show the above-described variant with an adhesive photoresist, and FIGS. 7*a* to 7*c* a method sequence in the production of a security element 1 according to the invention, in which there is employed, instead of the second security-element partial element shown in FIG. 2*c*, the second security-element partial element shown in FIG. 7*a*.

FIG. 1 shows a detail of a value document 2 according to the invention having a security element 1 according to the invention. The security element 1 is likewise depicted only as a detail. It shows a sun on a gold-colored ground, the sun 3 being a transparent disk with fine transparent rays. Inside the transparent sun disk there can be recognized, in silver color, the symbol 41 for the currency "EURO". The gold-colored and silver-colored areas are each configured as a diffractive structure.

With reference to the following figures it will be set forth by way of example how such a security element can be obtained according to the invention. There are shown in each case sections through the security element, or its partial elements, along the line A-A' in detail B.

FIG. 2*a* shows a first security-element partial element 10, consisting of a first carrier substrate 11, a UV radiation-transmissive foil of PET, an embossing lacquer layer 15 applied thereto and having an embossed diffractive structure 15' with a gold-colored metallization. The metallization forms a first functional layer 12 with golden first functional areas 13 and first gaps 14 therein. The diffractive structure 15' of the embossing lacquer layer 15 is also to be recognized in the first functional areas 13 as diffractive structure 13'. There is applied to the functional layer 12 an adhesive layer 30.

FIG. 2*b* shows the same representation as FIG. 2*a*, it being indicated by the arrows that the security-element partial element 10 is being irradiated with UV radiation. In the adhesive layer 30 there are indicated, separated by dashed lines, adhesive areas 33 shielded by the first functional areas 13 and, hence, not substantially changed in their adhesive force, as well as irradiated and thus deactivated adhesive areas 34. The line 40 under the first carrier substrate 11 indicates an external irradiation mask, whose importance will be explained later.

FIG. 2*c* shows a section through the second security-element partial element 20 to be combined with the first security-element partial element 10. The second security-element partial element 20 consists of the second carrier substrate 21, the second functional layer 22 and an embossing lacquer layer 25 therebetween. In the embossing lacquer layer 25 there is embossed a diffractive structure 25' which is reproduced in the second functional layer 22 as diffractive structure 22'. The second functional layer 22 involves a silver-colored metallization. The embossing lacquer 25 was washed off with an aqueous surfactant solution before application of the metallization 22, so that the metallization 22 adheres poorly to the embossing lacquer. Embodiments with different metallizations are particularly preferable.

Figure 2D:
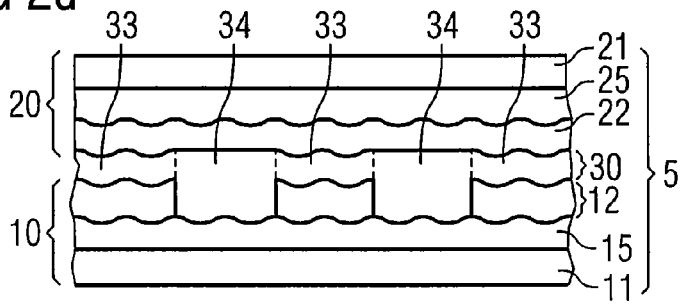

FIG. 2*d* shows how the irradiated first security-element partial element 10 from FIG. 2*b* and the second security-element partial element 20 from FIG. 2*c* are assembled to a composite 5. The two partial elements are pressed together slightly, thereby causing the diffractive structure 22' of the second functional layer in the non-cured areas 33 of the adhesive layer 30 to be transferred to the adhesive layer. In said areas the first security-element partial element and the second security-element partial element are bonded together. No bonding takes place in the irradiated, and thus deactivated, areas 34 of the adhesive layer. The adhesive is hard and inert, so that the diffractive structure 22' in the areas 34 is not transferred to the adhesive layer either, which is indicated by the smooth surface in the areas 34. For better curing of the areas 33 of the adhesive layer, irradiation can now be effected again, whereby irradiation must now be effected either through the first functional layer or through the second functional layer, which strongly reduces the efficiency of the irradiation and requires longer irradiation times. If the manufacturing process makes it possible to bond the first and the second security-element partial elements together immediately after irradiation, it is hence preferable to employ a cationically curing adhesive. Cationic radiation curing is a relatively slow process which still continues after the end of irradiation. In cationic radiation curing an acid is released which catalyzes the crosslinking reaction in the coating. Hence, if the adhesive is strongly irradiated in FIG. 2*b*, a crosslinking reaction is also initiated in the shielded adhesive areas 33, but only a very slight crosslinking is obtained within the chosen irradiation times. Hence, a bonding to the second security-element partial element is still possible without problems, and the adhesive areas 33 cure further by themselves within the composite 5. Dual-cure systems are also suitable.

Figure 2E:
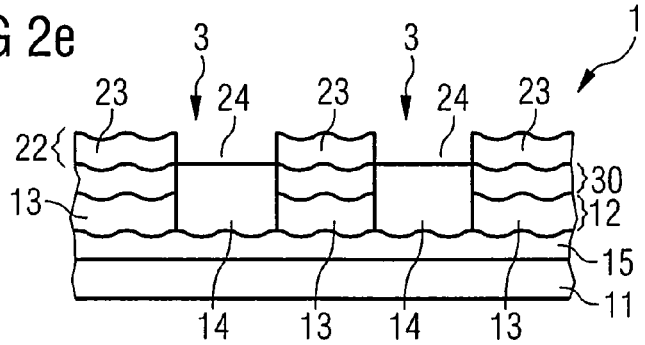

Now the second carrier substrate 21 and the embossing lacquer layer 25 are removed, for example by separation winding. The result is shown in FIG. 2*e*. The areas of the second functional layer 22 located over the adhesive areas 34 were removed together with the second carrier substrate and the embossing lacquer layer, while the areas of the second functional layer 22 bonded to the adhesive areas 33 were removed from the embossing lacquer layer. The bonded areas now form second functional areas 23 with second gaps 24 therebetween. The first gaps 14 and the second gaps 24 are exactly congruent and together form an opening 3 passing through both functional layers. The first functional areas 13 and the second functional areas 23 are of course also exactly congruent.

As the second security-element partial element there can for example also be used a hot stamping foil. In this case, only the second carrier substrate 21 would be removed upon separation winding, while the embossing lacquer layer 25 remains on the security element 1 formed. It can at the same time serve as a protective layer. It is quite generally expedient to provide a protective layer (not shown in the figure) over the second functional areas or the second functional layer.

If multilayer security elements are to be produced, the described method can also be repeated. Thus, a further adhesive layer can be applied to the security element 1 depicted in FIG. 2*e* and irradiated through the functional layers. It is thus possible to combine a further security-element partial element (as shown in FIG. 2*c*).

In FIG. 2*b* there is indicated by the reference number 40 an external exposure mask. The use of external masks is necessary when one of the functional layers is to contain functional areas at places where the other functional layer has gaps. When the gaps are accordingly large, no problems arise with regard to the attainable precision. In the cross section shown in FIG. 2*b*, the two gaps 14 in the first functional layer 12 correspond in each case to rays of the sun motif depicted in FIG. 1. The rays are very fine and, hence, rather unsuitable for the use of an additional external exposure mask. Imagining that one of the gaps corresponded to the sun disk, there would be present a gap with a relatively large surface area into which a further representation could be integrated, for example the EURO symbol 41 depicted in FIG. 1. If one irradiates the first security-element partial element 10 with the gold-colored first functional layer 12, as depicted in FIG. 2*b*, but with an exposure mask like the exposure mask 40 in the form of the EURO symbol being provided directly under the carrier substrate 11 in the area of that gap 14 corresponding to the sun disk, the adhesive layer does not cure in a corresponding area. Upon bonding to the second security-element partial element 20 the silver-colored second functional layer 22 also adheres in said areas. In addition to the second functional areas 23 there is formed a second functional area 41 integrated in the sun disk, in the described case the EURO symbol, which seems to be floating within the transparent sun disk. Upon use of different materials for the functional layers, both functional layers become visible at the same time from one viewing side. In the present case (FIG. 1) one sees in a plan view of the first functional layer a transparent sun in a gold-colored hologram inside which a silver-colored hologram in the form of the EURO symbol is floating.

FIGS. 3*a* to 3*e* show the same security-element partial elements 10 and 20 as FIGS. 2*a* to 2*e*. The same reference numbers designate the same elements. As opposed to FIGS. 2*a* to 2*e*, however, the adhesive layer 30 is attached here to the first carrier substrate, so that upon irradiation with the first functional layer 12 as an irradiation mask (FIG. 3*b*) the irradiation mask does not border directly on the adhesive layer to be irradiated. Hence, with the arrangement shown in FIG. 2 there can normally be effected a more precise imaging and thus also a more precise reproduction of extremely fine structures.

Figure 3A:
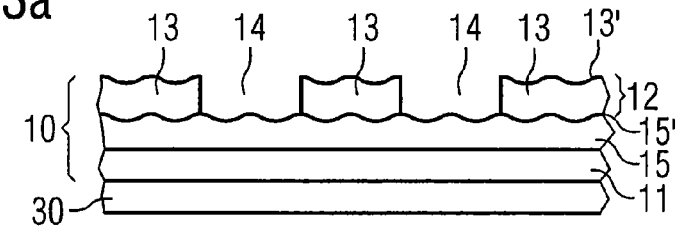
Figure 3B:
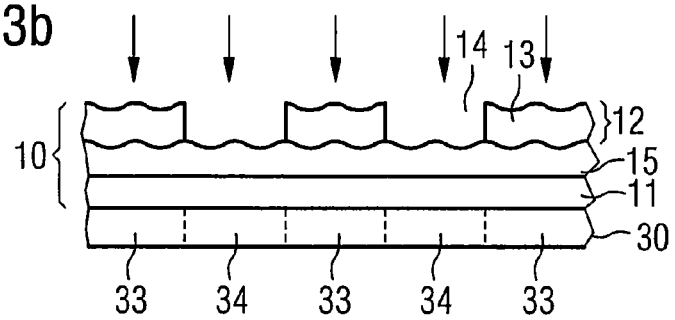
Figure 3C:
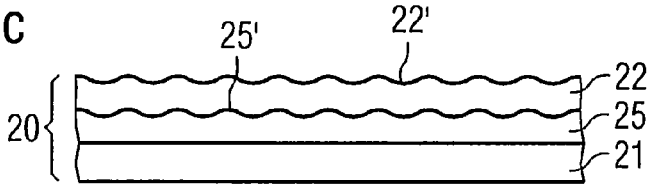
Figure 3D:
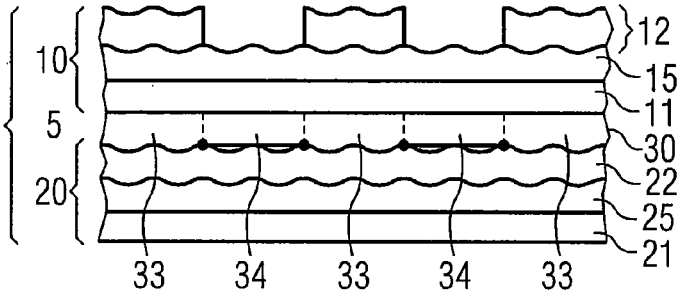
Figure 3E:
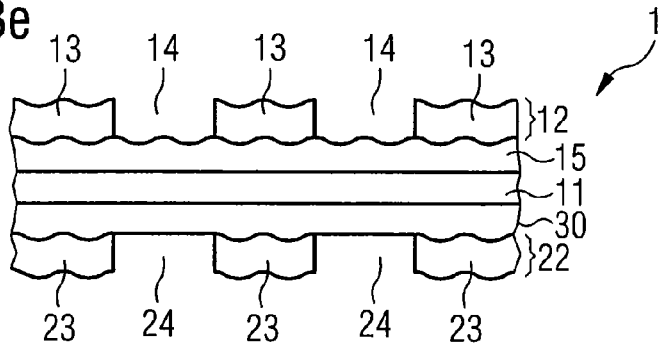

As evident from FIGS. 2*e* and 3*e*, there also result different layer sequences in the finished security element 1 in the shown variants. In the variant shown in FIG. 2, both functional layers 12 and 22 are arranged on the same side of the carrier substrate 11, while they are located on different sides of the carrier substrate in the variant shown in FIG. 3.

In the variants of the present invention shown in FIGS. 4 and 5, the adhesive layer 30 is applied to the second security-element partial element 20. Otherwise the representations of FIGS. 4*a* to 4*e* and 5*a* to 5*e* correspond to the representations of FIGS. 2*a* to 2*e* and 3*a* to 3*e*, respectively. The same reference numbers designate the same elements.

In the variants of the present invention shown in FIGS. 4 and 5, the adhesive layer 30 is applied to the second functional layer 22 of the second security-element partial element. For the first functional layer 12 of the first security-element partial element 10 to be employable as an irradiation mask, the two security-element partial elements must be joined together to the composite 5 before irradiation. This is possible with different orientation of the first security-element partial element, as shown in FIG. 4*c* and FIG. 5*c*. In the variant according to FIG. 4*c* the first functional layer 12 is bonded, and in the variant according to FIG. 5*c* the first carrier substrate 11 is bonded. To avoid an all-over bonding, there must be employed an adhesive that does not yet cause bonding upon a contact of the two security-element partial elements as is necessary for irradiation. The above-mentioned tack-free adhesives fulfill this condition. To prevent the partial elements from shifting relative to each other during irradiation, they can be temporarily fixed by a weak laminating adhesive. After the cure of the irradiated adhesive areas 34, the two security-element partial elements 10 and 20 are then bonded together by means of the non-irradiated adhesive areas 33 under elevated pressure and elevated temperature. The diffractive structure 13' of the first functional areas 13 is thereby transferred into the adhesive layer, as evident from FIG. 4*d*. The adhesive thus acts like an embossing lacquer layer.

Figure 4A:
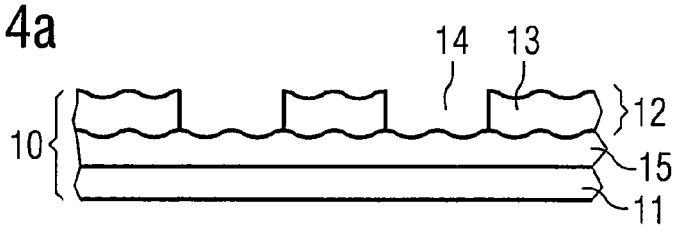
Figure 4B:
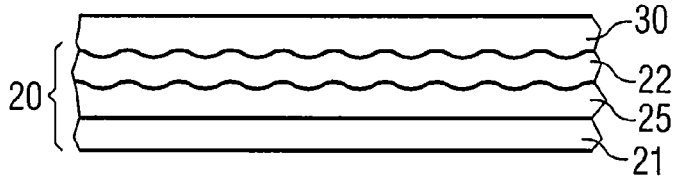
Figure 4C:
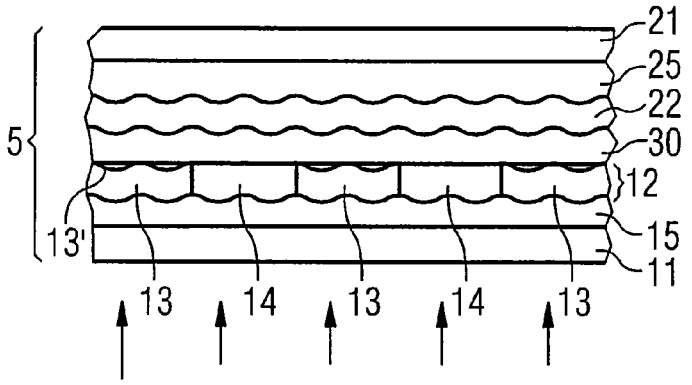
Figure 4D:
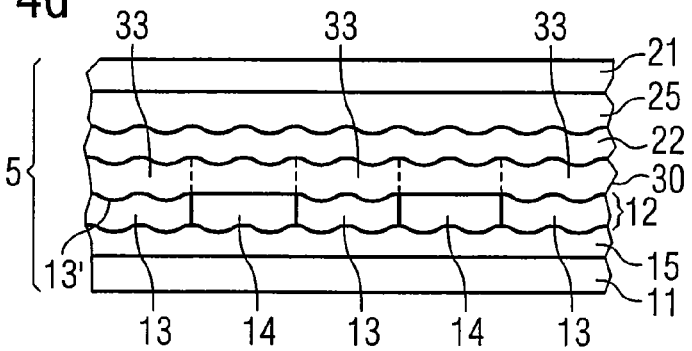
Figure 4E:
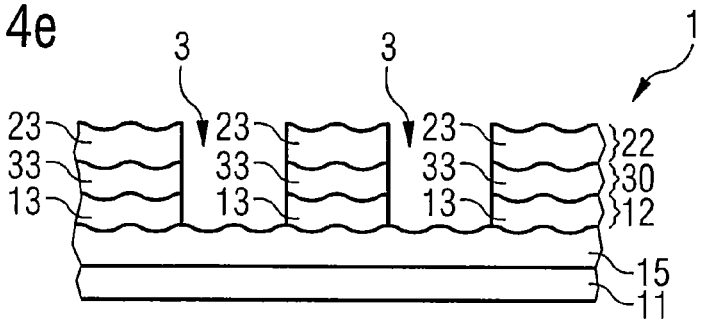

Because of the immediate adjacency of irradiation mask (first functional layer 12) and irradiated adhesive layer, a better imaging precision is possible in the variant according to the invention according to FIG. 4*c* than in the variant according to FIG. 5*c*. In both variants it has a disadvantageous effect with regard to the edge sharp-ness attainable upon separation that not only the second functional layer 22, but also the adhesive layer 30 must be severed (see FIGS. 4*e* and 5*e*).

FIGS. 2 to 5 describe the present invention on the basis of the use of a (curing) adhesive deactivatable by radiation. In the same way it is also possible to employ an adhesive activatable by radiation. In this case, the areas 34 of the adhesive layer 30 would in each case bond to the second functional layer 22, but not the areas 33.

FIGS. 6*a* to 6*e* show the variant of the present invention in which a thermoplastic resist lacquer is employed as an adhesive. The same reference numbers again designate the same elements as in the previous figures.

FIG. 6*a* shows a first security-element partial element 10 with first carrier substrate 11, embossing lacquer layer 15 with embossed diffractive structure 15', a metallization applied thereto as the first functional layer 12, and a resist lacquer layer 35 in the form of the desired motif. FIG. 6*a* thus shows the state of the first security-element partial element 10 in which the photoresist 35 was already irradiated and developed. Specifically, the photoresist 35 is irradiated through a mask, as shown in FIG. 6*f*, the mask being so structured that only the areas of the photoresist 35 where gaps 14 are to be formed are irradiated. In the embodiment shown, a positive photoresist is thus employed. The use of a negative photoresist would require an irradiation in the areas where the resist areas are to be formed. After irradiation, the photoresist is developed with a suitable developer, thereby obtaining the security-element partial element 10 that is shown in FIG. 6*a*.

By etching, the areas of the first functional layer 12 that are to form first gaps 14 are subsequently removed (FIG. 6*b*). FIG. 6*c* shows a second security-element partial element 20 which is identical with the security-element partial element shown in FIG. 2*c*. The two elements shown in FIG. 6*b* and FIG. 6*c* are assembled to a composite 5, as shown in FIG. 6*b*. The layer sequence is the same as in the composite 5 shown in FIG. 2*d*. By elevated pressure and elevated temperature the adhesive, in particular thermoplastic resist lacquer is activated and now bonds in the areas where it is in contact with the second functional layer 22 to said functional layer. The diffractive structure is thereby also transferred into the adhesive. After removal of the second carrier substrate 21 and the embossing lacquer layer 25, for example by separation winding, there is obtained the security element 1 shown in FIG. 6*e*, which seems to be identical with the security element 1 shown in FIG. 2*e*. In the security element shown in FIG. 2*e*, however, there is still adhesive in the gaps which can optionally be utilized for additional effects (for example can be colored), while in the security element shown in FIG. 6*e* no adhesive is present in the gaps. According to a further variant of the present invention, security-element partial elements with adhesive, in particular thermoplastic resist adhesive, like that shown in FIG. 6*b*, can be combined with security elements that already have several functional layers, like for example the security element 1 shown in FIG. 2*e*.

The method according to the invention permits an exactly registered and sharp-edged formation of extremely fine structures with a width or a diameter of about 50 μm or less.

Instead of a second security-element partial element wherein the motif of the functional layer is a metallized hologram or another metallized diffractive structure, it is alternatively possible to employ a second security-element partial element that has a carrier substrate with a layer formed thereon which is suitable for forming a metallized hologram or another metallized diffractive structure. For example, there can be employed instead of the second security-element partial element depicted in FIG. 2*c* a metal donor foil 20 without embossing, shown in FIG. 7*a*, which has a carrier substrate 21 with a metallization 220 formed thereon. The metallization 220 of the metal donor foil 20 is bonded to the adhesive layer 30 as in the method according to the invention shown in FIG. 2*d*. By detachment of the second carrier substrate 21 from the bonded composite 5 the metallization 220 is formed into areas 23, as shown in FIG. 7*b*. The areas 23 shown in FIG. 7*b* are areas suitable for forming diffractive structures. Subsequently, an embossing is carried out under pressure and temperature in order to form the areas 23 into metallized diffractive structures. The result is shown in FIG. 7*c*. The embossing tool used in this case can be for example an embossing cylinder, a normal embossed foil or a metallized embossed foil. The use of a metal donor foil without embossing as the second security-element partial element makes possible an optimal freedom in adjusting the metal adhesive force and a perfect uniformity, so that a metallization transfer is successful even at low temperatures.

The security elements according to the invention can be supplied in the form of transfer materials, i.e. foils or bands with a multiplicity of finished security elements prepared for transfer. In the case of a transfer material, the layer structure of the later security element is prepared on a carrier material in the reverse order in which the layer structure is later to be present on an object of value to be secured, whereby the layer structure of the security element can be prepared on the carrier material in endless form or already in the final outline form employed as the security element. The transfer of the security element to the object of value to be secured is effected with the help of an adhesive layer, which is typically provided on the transfer material, but can also be provided on the object of value. Preferably there is employed therefor a hot-melt adhesive. When the security element is prepared in endless form, there can, for transfer, either be provided an adhesive layer only in the areas of the security element to be transferred, or the adhesive is activated only in the areas to be transferred. The carrier material of the transfer elements is usually removed from the layer structure of the security elements during or after their transfer to the object of value. To facilitate stripping, there can be provided a separating layer (release layer) between the carrier material and the part of the security elements that is to be stripped. Optionally the carrier material can also remain on the transferred security element.

The security elements according to the invention can be employed for securing the authenticity of goods of any kind. Preferably they are used for securing the authenticity of value documents, for example in bank notes, checks or identification cards. They can be arranged here on a surface of the value document or be embedded wholly or partly in the value document. Especially advantageously they are used in value documents with a hole, for covering the hole. In this case, the advantages of the security elements according to the invention with transparent carrier substrates and carefully registered motifs to be viewed from both sides of the value document can be appreciated especially nicely. Negative writing with extremely fine structures can also be clearly recognized in transmitted light. It is practically impossible to imitate by a forger in the precision attainable according to the invention. It is also practically impossible to strip the security elements in order to transfer them to another object of value, because the security elements according to the invention always contain at least two adhesive layers, or they contain an adhesive layer and are connected with a further adhesive layer to the object of value to be secured. When there is employed for bonding the security element to the object of value an adhesive that is similar in its chemical and physical properties to the adhesive in the layer structure of the security element, the layer structure of the security element will always be destroyed in stripping attempts.

The invention claimed is:

1. A method for producing a security element for a security paper or an object of value, comprising the steps:

a) supplying a first security-element partial element, having
  a first carrier substrate,
  a first functional layer with first functional areas and first gaps,
  a layer of photoresist adhesive on the first functional layer, which is congruent with the first functional areas, b) supplying a second security-element partial element, having:
  a second carrier substrate,
  a second functional layer on the second carrier substrate or on an intermediate layer between the second carrier substrate and the functional layer, wherein the second functional layer is removable from the second carrier substrate or the intermediate layer, c) forming an adhesive layer from a radiation-conditionable adhesive on the first or the second security-element partial element, provided that no layer of photoresist adhesive is provided on the first functional layer of the first security-element partial element,
  c1) on the side of the first functional layer of the first security-element partial element or
  c2) on the side of the first carrier substrate of the first security-element partial element, or
  c3) on the side of the second functional layer of the second security-element partial element, d) assembling the first and the second security-element partial elements to a composite in such a way that
  d1) when the adhesive is provided on the first security-element partial element, the adhesive layer and the second functional layer of the second security-element partial element face each other, or
  d2) when the adhesive is provided on the second security-element partial element, either the adhesive layer and the first functional layer of the first security-element partial element or the adhesive layer and the first carrier substrate of the first security-element partial element face each other, e) irradiating the adhesive layer in the cases where a radiation-conditionable adhesive is provided,
  in the case of c1) of step c, where the radiation-conditionable adhesive is provided on the first security-element partial element, alternatively before the assembling of the composite by irradiation of the first security-element partial element through the first functional layer,
  wherein the first functional layer of the first security-element partial element acts as an irradiation mask, so that in the adhesive layer there are formed non-irradiated areas congruent with the first functional areas, and areas conditioned by irradiation that are congruent with the first gaps, f) bonding the first and the second security-element partial elements, whereby the bonding is caused by the non-irradiated areas, or by the conditioned areas of the adhesive layer, or by the areas with photoresist adhesive, g) detaching the second carrier substrate from the bonded composite, wherein the second functional layer, so as to form second functional areas, either
  g1) adheres to the non-irradiated areas of the adhesive layer but does not adhere to the conditioned areas of the adhesive layer and is detached together with the second carrier substrate, or
  g2) adheres to the conditioned areas of the adhesive layer but does not adhere to the non-irradiated areas of the adhesive layer and is detached together with the second carrier substrate, or
  g3) adheres in the areas with photoresist adhesive but does not adhere in the areas without photoresist adhesive and is detached together with the second carrier substrate.

2. The method according to claim 1, wherein the radiation-conditionable adhesive employed is a radiation-crosslinkable adhesive, and the conditioning of the areas comprises a loss of adhesive force of the adhesive in said areas by crosslinking of the adhesive.

3. The method according to claim 1, wherein the radiation-conditionable adhesive employed is a radiation-activatable adhesive, and the conditioning of the areas comprises an attainment of the adhesiveness of the adhesive in said areas.

4. The method according to claim 1, wherein as the first carrier substrate there is employed a transparent or translucent foil.

5. The method according to claim 1 wherein the first security-element partial element is produced by
  supplying a first carrier substrate,
  applying a first embossing lacquer layer to the first carrier substrate,
  applying a first metallization to the first embossing lacquer layer,
  embossing the first embossing lacquer layer before or after applying the first metallization, and
  forming first gaps in the first metallization.

6. The method according to claim 1, wherein the second security-element partial element is produced by supplying a second carrier substrate, applying a second embossing lacquer layer to the second carrier substrate, applying a second metallization to the second embossing lacquer layer, embossing the second embossing lacquer layer before or after applying the second metallization, and forming second gaps in the second metallization.

7. The method according to claim 1, wherein the irradiation in step e) is performed in addition through a second irradiation mask.

8. A security paper or object of value such as a bank note, a check or an identification card, comprising a security element according to claim 1.

* * * * *